US006695711B2

(12) United States Patent
Blough

(10) Patent No.: US 6,695,711 B2
(45) Date of Patent: Feb. 24, 2004

(54) HYDROFORMED METALLIC GOLF CLUB SHAFTS AND METHOD THEREFORE

(75) Inventor: Robert Thomas Blough, Avon, CT (US)

(73) Assignee: Royal Precision, Inc., Torrington, CT (US)

( * ) Notice: Subject to any disclaimer, the term of this patent is extended or adjusted under 35 U.S.C. 154(b) by 0 days.

(21) Appl. No.: 10/058,955

(22) Filed: Jan. 28, 2002

(65) Prior Publication Data

US 2003/0144073 A1 Jul. 31, 2003

(51) Int. Cl.[7] ..... A63B 53/12
(52) U.S. Cl. ..... 473/289; 473/316; 29/421.1
(58) Field of Search ..... 473/316–323, 473/289; 29/421.1; 75/711

(56) References Cited

U.S. PATENT DOCUMENTS

| | | | | |
|---|---|---|---|---|
| 1,740,144 A | * | 12/1929 | Barrett | 425/405.1 |
| 1,884,589 A | | 10/1932 | Davies | |
| 2,344,779 A | | 3/1944 | Kolderman et al. | |
| 3,564,886 A | | 2/1971 | Nakamura | |
| 4,169,595 A | * | 10/1979 | Kaugars | 473/323 |
| 5,203,190 A | | 4/1993 | Kramer et al. | |
| 5,481,892 A | | 1/1996 | Roper et al. | |
| 5,524,466 A | | 6/1996 | Coe | |
| 5,620,380 A | | 4/1997 | Tennent et al. | |
| 5,857,921 A | * | 1/1999 | Braly et al. | 473/289 |
| D407,456 S | | 3/1999 | De La Cruz et al. | |
| 5,944,616 A | * | 8/1999 | Horwood et al. | 473/289 |
| 5,976,032 A | * | 11/1999 | You | 473/319 |
| 6,014,879 A | | 1/2000 | Jaekel et al. | |
| 6,044,678 A | | 4/2000 | Olszewski | |
| 6,071,460 A | | 6/2000 | Renaudin et al. | |
| 6,216,509 B1 | | 4/2001 | Lotspaih et al. | |
| 2001/0014626 A1 | | 8/2001 | Takiguchi et al. | |

* cited by examiner

*Primary Examiner*—Stephen Blau
(74) *Attorney, Agent, or Firm*—Hudak, Shunk & Farine Co. LPA

(57) ABSTRACT

A golf club shaft, set of shafts, or golf clubs having shafts which have been produced by a process that includes a hydroforming step. By utilizing a hydroforming step, a metal or metal matrix composite golf club shaft can be formed into a variety of configurations or shapes heretofore not possible and can include hydroformed ornamental design features. The hydroformed shafts offer enhanced club feel and/or performance.

25 Claims, 2 Drawing Sheets

HYDROFORMED METALLIC GOLF CLUB SHAFTS AND METHOD THEREFORE

FIELD OF THE INVENTION

The present invention relates to golf club shafts, in particular metal or metal matrix composite golf club shafts, which have been produced by a process that includes a hydroforming step. By utilizing a hydroforming step, a golf club shaft can be constructed having a variety of forms or shapes heretofore not possible. Advantageously, the hydroformed shafts can be configured to enhance club feel or performance, or even to include hydroformed ornamental design elements which can be located in any or all of a tip, grip, or intermediate sections of the shaft.

BACKGROUND OF THE INVENTION

The prior art golf clubs and shafts thereof have a degree of flexibility that is greatly dependent on the shaft material. Each individual golfer, especially a skilled player, has a preference for certain characteristics, such as feel, in a golf club or set of clubs. Generally feel is measured by the flexibility of the golf club shaft. One golfer may prefer a stiff feel, while others may prefer a more flexible club. Flexibility of golf club shafts can even vary from one section of the shaft to another, such as in the tip, butt, and intermediate sections.

U.S. Pat. No. 5,620,380 to Tennent et al. relates to a light weight golf club shaft described as having a "modified hourglass" shape which provides many predetermined combinations of flex, stiffness and torque which together are perceived as shaft and club "feel." The shaft reportedly reduces shaft weight to the level desired by a golfer by using a substantially uniform shaft wall thickness while maintaining the unique "hour glass" external profile of our previous shaft. The shaft is formed of a base with axial sections: a grip section, an upper flare section, a flex control section, a lower flare section, and a hosel section, the whole forming an exterior shaft profile. The shaft may be made from metal such as steel, titanium, aluminum or their alloys, or composites formed of reinforcing fibers and polymeric materials. The preferred fibers for reinforcement are the carbon, ceramic, metallic, glass, aramid and extended chain polyethylene fibers, most preferably the carbon fibers. Preferred among the polymers which may be used are thermosetting resins such as the phenolics, polyesters, melamines, epoxies, polyimides, polyurethanes and silicones. The shafts reportedly may be produced by a variety of methods, including casting, molding (as around one or more mandrels), expanding or drawing.

U.S. Pat. No. 6,071,460 to Renaudin et al. relates to an apparatus for manufacturing a reinforced golf club shaft having a complex shape. An inflatable bladder is positioned over a mandrel having a simple shape. Layers of fiber material are then rolled over inflatable bladder to produce a sub-assembly. The sub-assembly is placed in a mold defining a negative of the shape of the final shaft that is to be produced. The impression may have enlarged or narrowed regions for producing irregularities in the shape of the shaft. The bladder is expanded within the mold so that the composite structure is radially displaced and compressed between the bladder and the mold. The inflatable bladder has a variable thickness that conforms to the shape of the impression so that the composite structure undergoes a uniform and minimum displacement along its entire length, which reportedly improves the mechanical properties of the final shaft.

U.S. Patent Application Publication No. 2001/0014626 to Takiguchi et al. relates to a golf club shaft and a method especially suited for producing the shaft that reportedly provides high rigidity and ease of use and that allows inexpensive and easy manufacture. A sloped section 16 expanding toward a grip end 14 is formed. The sloped section has a slope gradient of 15/1000–35/1000 and a length of 200–350 mm. The outer diameter of the grip end is 18–25 mm. On the side of the sloped section toward an end 18, there is formed a semi-sloped section 19 with a slope gradient of 4/1000–13/1000. A kick point is formed at a position 40–46% from the small-diameter end relative to the shaft length.

The prior art golf club shafts and processes for making the same have been limited in design and functionality by their production devices. The golf club shafts of the present invention overcome the aforementioned problems.

SUMMARY OF THE INVENTION

The present invention relates to a golf club shaft, a set of shafts, or golf clubs formed from the shafts of the present invention and a method of production therefore. The shafts are produced by a process which includes a hydroforming step, wherein the shaft is expanded by fluid to fit the dimensions of a hydroform mold.

The shafts of the present invention are generally produced by the following process. First, a tube is formed by any of a number of procedures. In one method, a planar piece of metal is formed and welded into a tube. Alternatively, a seamless tube can be formed by an extrusion process. The tube is subsequently annealed at least once. Preformed or manufactured tubing could be otherwise be utilized. The tube is drawn over a number of mandrels producing a shaft blank. The shaft blank can have any number or multitude of thicknesses, i.e. generally from 1 to about 10 and preferably from 1 to about 6, with a constant outer diameter at this point in the process. The shaft is then end formed by compressing the tube axially through a series of cylindrical dies, the inside diameters of the dies being less than the shaft outer diameter, to produce a stepped blank. A stepped blank generally has grip and tip sections with constant outer diameters and an interconnecting section which optionally may contain numerous steps or gradations from a larger diameter progressively to a smaller diameter. The shaft generally has exterior dimensions which are slightly smaller than that of the female hydroform mold utilized in the hydroforming process. The shaft is placed into a hydroform mold and fluid is introduced into the shaft wherein the pressure therefrom causes various portions of the shaft to expand outward and contact the mold surfaces. Advantageously, shafts with variable outer and/or inner diameters and variable wall thicknesses, and/or nonprogressive modifications can be formed. The hydroformed shaft is cut to length and finished with optional steps such as heat treating, polishing and plating.

BRIEF DESCRIPTION OF THE DRAWINGS

The invention will be better understood and other features and advantages will become apparent by reading the detailed description of the invention, taken together with the drawings, wherein.

DETAILED DESCRIPTION OF THE INVENTION

Figure 1:
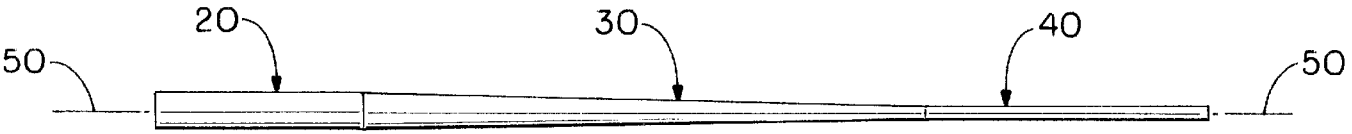
FIG. 1 is a side elevational view of a golf club shaft of the present invention which has been formed by a process including a hydroforming step.

The present invention can be better understood by reference to the drawings, wherein FIG. 1 shows an example golf club shaft produced by the method of the present invention. The shaft 10 generally includes a grip or butt section 20, an intermediate section 30, which is preferably tapered, and a tip section 40. The shaft 10 has a substantially cylindrical shape, with the tip section having a smaller outer diameter than the grip section.

Preferably, the grip section and the tip section have constant or substantially constant outer diameters, i.e. having wall ends which appear parallel to each other when viewed from the side. It is also possible for the tip and grip sections to be tapered. Depending on the effect desired, the inner diameters of one or more of the shaft grip, intermediate, and tip sections can be varied along the length of the respective sections. The grip, intermediate, and tip sections 20, 30, 40 typically have a common central longitudinal axis 50, as shown in FIG. 1, however the hydroformed shafts may be formed having a non co-linear longitudinal axis.

The golf club shafts or shaft blanks of the present invention are formed from tubes of metal or a metal matrix composite. When utilized herein, tube generally refers to a hollow cylinder or pipe having a constant outer diameter. The inner diameter, and thus the transverse cross sectional thickness throughout the length of the tube, can be constant or vary in one or more areas. That is, the inner diameter and thus the wall thickness, can be varied throughout the length of the tube, and can even contain "cycles" or repeating patterns such as but not limited to sinusoidal cycles. The tube is generally considered a shaft after a process modifies, i.e. increases or decreases, at least a portion of the outer diameter so the same is no longer constant. The shaft is still a "tube" after being formed, albeit a specialized tubular blank having a special use. In the preferred embodiment, the shaft 10 is manufactured from metal such as steel, titanium, aluminum, or alloys thereof. The shaft can also be a metal matrix composite as known in the art, wherein a matrix metal such as but not limited to aluminum surrounds or envelopes fibers such as silicon carbide whiskers.

While manufactured tubes can be utilized, it is often desirable to begin the shaft formation process utilizing a planar piece or strip of metal. While thickness of the planar piece is not critical, the piece preferably has a constant thickness, with suitable ranges being generally from about 0.030 to about 0.090 inches, and preferably from about 0.045 to about 0.055 inches thick. The planar piece is roll formed and welded by induction or resistance methods, well known to those of ordinary skill in the art, into a tube having an outer diameter of about 0.70 to about 1.50 inches, and preferably from about 0.90 to about 1.0 inch. Obviously, premanufactured welded or seamless tubes would have the same dimensions.

Alternatively, the shaft formation process can be started by utilizing a seamless tube which has been formed by an extrusion process as known to those of ordinary skill in the art having the above mentioned dimensions. The length of the tube at this point of the operation is not critical.

The tube is optionally annealed to soften or further prepare the material for subsequent forming. As known to those of ordinary skill in the art, the temperatures, times and types of atmospheres, i.e. air or inert environment, can vary depending on the metal or metal matrix composite utilized.

Figure 2:
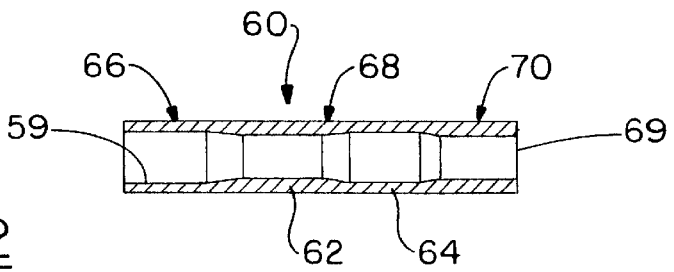
FIG. 2 is a cross section through a longitudinal axis of a tube wherein variable wall thicknesses have been formed into the same during a drawing step.

The tube is drawn over at least one mandrel as stated hereinabove utilizing drawing practices known to those of ordinary skill in the art. The tube also can be annealed before, between, or after any of the drawing process steps. If desired, variable wall thicknesses can be introduced into the tube during a final drawing step so that tube has a constant outer diameter but a variable inner diameter. This is accomplished by moving a tapered inner mandrel in relation to an outer forming die while the tube material is drawn therebetween. FIG. 2 shows an example of a tube 60 having variable wall thickness. The tube is shown having two transition cycles, each having a relatively heavy or thick wall section 62 and a light or thin wall section 64. Importantly, wall section areas 69 of variable thickness can be utilized to provide a finished club with a desired feel and can be tailored to suit individual golfers needs. It is to be understood that the present invention is not meant to be limited in scope to the embodiment of FIG. 2.

The present invention tubes or shafts can be formed with any number and combinations of varying wall thicknesses. Often, as shown in FIG. 2, it is desirable to provide the tube 60 with a grip end 66 having a relatively thinner wall section 59 than the tip section 70. As illustrated, intermediate section 68 includes sections of varying thickness. After the tube or shaft has been drawn, it has an outer diameter of generally about 0.500 to about 0.750 inches, desirably from about 0.550 to about 0.650 inches, and preferably about 0.600 inches. Once the wall thickness and diameter of the tube are within a desired range, the tube is cut into unit lengths, preferably between 37 and 47 inches. Wall thickness must be sufficient to impart the necessary strength and stiffness to the golf club shafts, but excess wall thickness is avoided because it adversely contributes to the weight of the shaft.

The tube is preferably step formed into a shaft. The step pattern is formed in the shaft by holding the grip end of the shaft rigidly, and pushing the opposite end of the tube, which will become the tip section of the shaft, axially through one of more cylindrical dies, the inside diameter of which are less than the grip end diameter. The tube is pushed sufficiently far through each die such that the shaft obtains the appropriate diameter of each point along its length. Desirably, the grip end outside diameter is equal to, or slightly smaller than the inside diameter at or near the corresponding grip end of the hydroform mold, and the tip end outside diameter of the shaft is equal to or slightly smaller than the inside diameter at or near the tip end of the hydroform mold. That is, the shaft, before hydroforming, has section(s) with outer diameter(s) or dimensions which are generally at least about 50% desirably about 60%, 75%, or 85%, and preferably at least about 87% or 90% of the corresponding inner diameter dimensions of the female hydroform mold.

The shaft is subsequently hydroformed in a hydroforming apparatus. U.S. Pat. No. 6,014,879 describes a suitable hydroforming apparatus and is fully incorporated herein by reference. Other suitable hydroforming apparatuses are available from Airmo Inc. of Minneapolis, Minn. The process entails placing the shaft into one half of the female hydroform mold. The halves of the hydroform mold comprise one of more machined sections which are individually contoured to produce a desired shaft. Generally one of the mold halves is mounted on a moveable slide that allows the mold to be moved for shaft loading and unloading. The apparatus contains a mold portion which is carried by a platen driven up and down vertically by hydraulic cylinders. After a tube is placed on the slidable mold section, the assembly is moved horizontally into position under the opposite mold section. The platen carrying the mold section is then hydraulically driven down into contact with the lower mold section by low-pressure hydroforming fluid.

Once the upper and lower mold sections are in position, the tube-end engaging structures, or high-pressure end closures seal opposite ends of the shaft in the assembled hydroform mold.

Hydroforming fluid, such as but not limited to water, or a water mixture, is first introduced into the tube blank by a low pressure centrifugal pump. Once the tube blank and platen hydraulic cylinders have reached the equilibrium pressure of the low pressure pump, typically 70–90 psi, they are further pressurized by a air over hydraulic intensifier pump (or pumps) to further pressurize the interior of the tube blank. As the internal pressure in the tube exceeds the materials yield strength, generally pressure great enough to exceed the yield strength of the material being formed or from about 10,000 to about 50,000, and preferably from about 15,000 to about 20,000 psi, the tube blank expands. Expansion continues until the blank material contacts and substantially conforms to the shape of the inner surface of the hydroform mold.

The tube is pressurized to a preset pressure or for a preset length of time, which depends at least in part to the material utilized. Once these parameters are met, the pressure is removed from inside the tube, and from the hydraulic platen cylinder. The tube-end engaging structures are disengaged from the mold, and the mold platen is raised. The slidable mold section is then moved to the unload position and the expanded shaft removed from the mold cavity.

After the shaft has been hydroformed, the same is cut to a desired length for the club being formed. Furthermore, additional processing steps to impart necessary strength and cosmetic appearance to the shaft such as but not limited to heat treating, polishing, and plating, can be performed depending on the metal or metal matrix composite utilized as known to those skilled in the art.

Figure 3:
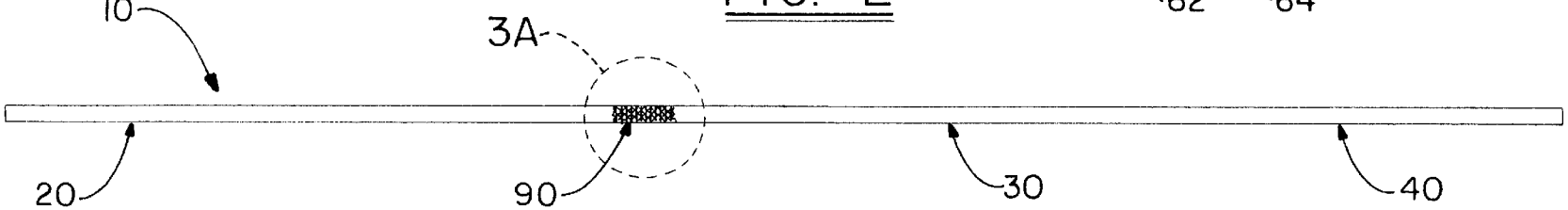
FIGS. 3 and 3*a* are side elevational views of a shaft which has been hydroformed. The shaft includes parallel tip and butt sections and an interconnecting section. The interconnecting section includes a hydroformed ornamental design.
Figure 3A:
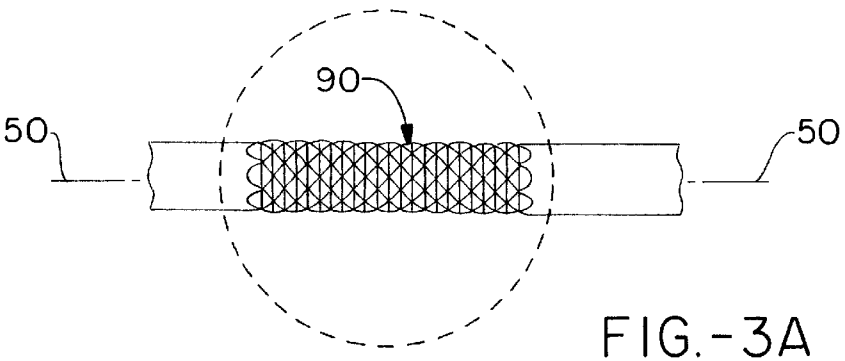

Importantly, the hydroform mold can be designed with a variety of configurations to produce a golf club shaft which alternatively can enhance club feel, performance, or aesthetic design. The hydroforming process is capable of producing current industry standard constant taper and step shafts, but also allows for non-progressive or variable inner and/or outer diameter changes other than a step change throughout the length of the shaft. That is, at least one portion of the inner diameter can have any number of shapes such as sinusoidal, curvilinear, concave, convex, etc., linear tapered inward or outward, and the like. While generally not varied as often, at least one portion of the outer diameter can have any number of the shapes just noted. Moreover, the wall thickness of the shaft can vary in at least one portion from thinner to thicker, from thicker to thinner, and the like. Shafts thus can be created which include features or ornamental designs, such as but not limited to hour glass shapes, bubble shapes, multiple protrusions, indentations, flutes, grooves, and/or ridges that can be added at any point along the shaft. Performance enhancing grooves and ridges can be oriented at any angle on the shaft from annular rings to bias lines, to parallel lines. Geometric or arbitrary patterns, logos, trademarks, symbols, quality markings, manufacturing names, etc., can also be formed on or in the shaft. FIG. 3 shows a shaft 10 having a tip 40, butt 20 and interconnecting section 30 which includes an ornamental design 90. In this case, the ornamental design is a repeating diamond pattern. FIG. 3A is an enlarged cut away view of the ornamental design shown in FIG. 3.

Figure 4:
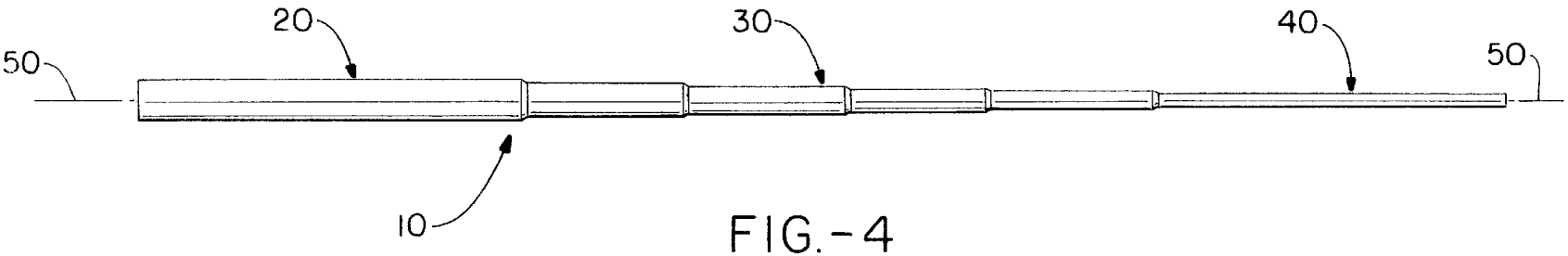
FIG. 4 is a side elevational view of a hydroformed shaft wherein the intermediate section has been stepped during the hydroforming process.

FIG. 4 shows a hydroformed golf club shaft 10 having parallel tip 40 and grip 20 sections with a tapered interconnecting multiple step section 30.

Advantageously, the hydroformed shafts of the present invention can be frequency matched to further enhance performance of a set of golf clubs. Methods for frequency matching golf club shafts are at least found in U.S. Pat. Nos. 4,070,022 and 4,122,593, which are herein fully incorporated by reference.

These methods comprise the steps of hydroforming shafts, of any desired design, shape, etc., determining under similar conditions the frequency of each golf club shaft selected from a plurality of shafts. After the frequency determinations are made, shafts are selected that have a frequency which falls on a predetermined gradient formed by a plot of shaft frequency and shaft length. Subsequent mating of the hydroformed shafts with weight matched club heads produces matched golf clubs.

More specifically, the step determining the frequency of each hydroformed shaft includes securing the butt end of the shaft in place at a stationary location or chuck. A predetermined test weight is fixed to the tip end of the shaft after which the shaft is excited so that it oscillates. The test weight may be 250 to 300 grams, for example. The shaft oscillations are then measured utilizing the photoelectric counter unit. The details of the photoelectric counter unit are known to the art and do not form any specific part of the present invention. In this regard, any convenient method of measuring the oscillations of the shaft during the frequency determination may be used.

Preferably, the frequency gradient is a substantially straight line that increases and the shaft length decreases. The frequency increments between successive shaft lengths along the gradient are substantially equal.

After these frequency determinations are plotted, a straight line gradient is drawn such that it is representative of the recorded frequency information. Hydroformed golf club shafts are then selected so that the frequencies of each shaft set fall on the gradient.

This terminology is not intended to imply that each shaft frequency of a matched set falls directly on the gradient but instead to include frequencies close to the gradient by a factor of ±1 or 2; or ±1/2 cycles per minute.

Another aspect of the present invention is that while it is preferred that each predetermined frequency gradient be a substantially straight line, other gradients are also within the scope of the invention. In this regard, the frequency gradient of the matched golf club shafts may be slightly curved in either an upward or downward direction, for example, rather than straight.

As noted above, the present method of producing hydroformed matched golf clubs includes securing selected club heads to the frequency matched shafts. In selecting club heads of the iron or wood type, the weight of each club head of a series is classified as to number and weight. Thereafter, club heads are selected such that the weights thereof fall on a predetermined gradient formed by a plot of head weight and club number. The weight increments between successively numbered club heads are substantially equal. Here again, it is within the scope of the present invention that the weights fall on the predetermined gradient with a margin of error of ±1–2; or ±1/2 grams. While it is preferred that the weight gradient be substantially straight, and increase as the club number increases, the gradient may be slightly curved in an upward or downward direction and increase as the club number increases within the scope of the invention.

According to the present invention, it is also seen that hydroformed shaft length, shaft weight, center of gravity of shaft, flex of shaft, and mass of golf club head are integrated into a clearly definable integer, making possible the matching of a set of hydroformed golf clubs based upon frequency determinations. These frequencies are modulated to conform to the requirements of the individual golfer.

Hydroformed shafts all having the same length can also be used in the production of golf club sets. Here the hydroformed shafts are individually cut to the desired length which eliminates the purchase of club shafts of varying lengths. Utilizing the present invention, the frequency of each of these hydroformed shafts is determined prior to cutting them to the desired lengths. After the frequency determinations are made, the shafts are classified into groups of substantially the same frequency. The shafts needed for a golf club set are then selected from one of these groups after which such shafts are cut to the desired shaft lengths. Weight matched club heads are then secured to the matched shafts. The desired swing weight of the set is made by equally adjusting the weight of each of the heads prior to securing them to the shafts.

After the golf club sets are assembled, the frequency of each of the clubs thereof is determined to verify that the set is integrated and correlated within ±1–2; or ±1/2 cycles per minute. Thus, the hydroformed shafts of the present invention can be utilized to produce a frequency matched set of golf clubs.

The hydroformed golf club shafts of the present invention having various features such as external protrusions, indentations, grooves, etc., can also be produced with rifling to increase the strength and/or performance of the golf club shafts. Rifled golf club shafts and methods for producing the same are described in U.S. Pat. No. 5,857,921, herein fully incorporated by reference.

Figure 5:
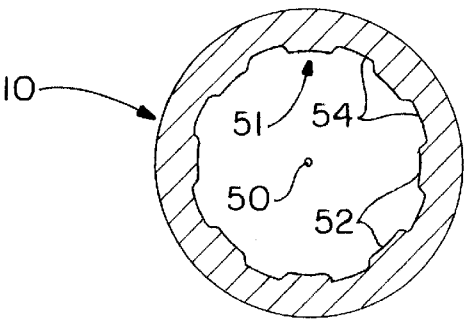
FIG. 5 is a transverse cross sectional view of a portion of a hydroformed blank in which rifling has been introduced into the interior wall of the shaft during the drawing process.

Rifling 51 is metallurgically formed on the interior surface of the shaft 10 and the rifling preferably extends throughout the entirety of the butt, tip and tapered sections. Rifling 51 is shown in the cross-sectional view of FIG. 5. Specifically, the rifling comprises a plurality of alternating longitudinally extending lands 52 and grooves 54. The longitudinally extending lands 52 are generally equally spaced apart and the longitudinally extending grooves 54 are equally spaced apart.

As is clear from the drawing, the preferred butt and tip section 20, 40 have a common central longitudinal axis 50 which also extends through tapered intermediate section 30. The alternating longitudinally extending lands and grooves in the butt and tip sections are parallel to one another and also parallel to the common central longitudinal axis 50. The rifling in the tapered section is longitudinally extending but generally converges by the angle of taper in the direction from the butt section to the tip section.

Preferably the rifling includes at least eight lands 52 and at least eight grooves 54 extending throughout the entirety of the butt, tip and tapered sections. The rifling imparts strength and stiffness to the tubular shaft 10 without adding additional weight.

During the process of forming the tubular stock from which shaft 10 is fabricated, the tubular stock is additionally drawn over a plug mandrel having alternating longitudinally extending parallel lands and grooves on an outside surface thereof, preferably at one end. The tubular stock is simply drawn over the plug mandrel to form rifling 51 on the inside surface of the tubular stock, such rifling being in the form of the plurality of alternating longitudinally extending lands and grooves 52, 54. Subsequently thereto, it is hydroformed to contain any desirable feature, logo, etc. thereon as noted above. Such hydroformed shafts can also be frequency matched as noted above.

While in accordance with the patent statutes the best mode and preferred embodiment have been set forth, the scope of the invention is not limited thereto, but rather by the scope of the attached claims.

What is claimed is:

1. A hydroformed golf club shaft, comprising;

a fluid expanded grip section, a fluid expanded tip section, and a fluid expanded intermediate section, said intermediate section interconnecting said grip and tip sections, said shaft being metal or metal-matrix composite, wherein each of said sections have inner and outer diameters.

2. A shaft according to claim 1, wherein said tip and grip sections have substantially constant outer diameters.

3. A shaft according to claim 2, wherein said grip section has an outer diameter greater than said tip section outer diameter.

4. A shaft according to claim 3, wherein said shaft includes metallurgically formed rifling in an interior surface of the shaft which extends throughout the entirety of the tip, grip, and intermediate sections, said metallurgically formed rifling comprising a plurality of alternating longitudinally extending lands and grooves wherein the depth of said grooves does not exceed the widths of said lands, and wherein the lands and grooves in the tip section are parallel to each other and the lands and grooves in the butt section are parallel to each other.

5. A set of said shafts, with each shaft having the structure of the shaft according to claim 3, wherein said shafts are frequency matched.

6. A shaft according to claim 1, wherein said intermediate section inner diameter varies along a length thereof.

7. A shaft according to claim 1, wherein said intermediate section has a wall section thickness that varies in at least one portion along the length of said section.

8. A shaft according to claim 1, wherein said tip section, said grip section, or said intermediate section, or a combination thereof, includes a hydroformed ornamental design.

9. A shaft according to claim 1, wherein each said outer diameter section has an expansion percentage of less than 50% of the respective pre-expanded outer diameter.

10. A shaft according to claim 9, wherein said intermediate section outer diameter expansion percentage is less than about 25%.

11. A shaft according to claim 10, wherein said intermediate section outer diameter expansion percentage is less than about 10%.

12. A hydroformed golf club shaft, comprising:

a grip section, a tip section, and a fluid expanded intermediate section connecting said grip section and said tip section, said sections having a common central longitudinal axis, said shaft being metal or metal-matrix composite, said tip section having a smaller outer diameter than said grip section.

13. A shaft according to claim 12, wherein said intermediate section is tapered and has a constant taper or a step section taper.

14. A shaft according to claim 13, wherein said tip section, or said grip section, or both are fluid expanded.

15. A shaft according to claim 14, wherein said shaft includes a fluid expanded ornamental design.

16. A shaft according to claim 15, wherein said ornamental design is located on said intermediate section.

17. A set of said shafts, with each shaft having the structure of the shaft according to claim 14, wherein said shafts include metallurgically formed rifling in an interior surface of the shaft which extends throughout the entirety of the tip, grip, and intermediate sections, said metallurgically formed rifling comprising a plurality of alternating longitudinally extending lands and grooves wherein the depth of said grooves does not exceed the widths of said lands, and wherein the lands and grooves in the tip section are parallel to each other and the lands and grooves in the butt section are parallel to each other.

18. A shaft according to claim 13, wherein said grip section and said tip section have substantially constant outer diameters.

19. A shaft according to claim 13, wherein said grip section or said tip section, or both are tapered.

20. A shaft according to claim 13, wherein said shaft includes a fluid expanded ornamental design.

21. A set of said shafts, with each shaft having the structure of the shaft according to claim 13, and wherein said shafts are frequency matched.

22. A set of said shafts, with each shaft having the structure of the shaft according to claim 13, wherein said shafts include metallurgically formed rifling in an interior surface of the shaft which extends throughout the entirety of the tip, grip, and intermediate sections, said metallurgically formed rifling comprising a plurality of alternating longitudinally extending lands and grooves wherein the depth of said grooves does not exceed the widths of said lands, and wherein the lands and grooves in the tip section are parallel to each other and the lands and grooves in the butt section are parallel to each other.

23. A shaft according to claim 13, wherein each said outer diameter section has an expansion percentage of less than 50% of the respective pre-expanded outer diameter.

24. A shaft according to claim 23, wherein said intermediate section outer diameter expansion percentage is less than about 25%.

25. A shaft according to claim 24, wherein said intermediate section outer diameter expansion percentage is less than about 10%.

* * * * *